US007530716B2

(12) United States Patent
Mayfield, III et al.

(10) Patent No.: US 7,530,716 B2
(45) Date of Patent: May 12, 2009

(54) LIGHT FIXTURE

(75) Inventors: John T. Mayfield, III, Loganville, GA (US); Stephen H. Lydecker, Snellville, GA (US)

(73) Assignee: Acuity Brands, Inc., Atlanta, GA (US)

( * ) Notice: Subject to any disclaimer, the term of this patent is extended or adjusted under 35 U.S.C. 154(b) by 325 days.

(21) Appl. No.: 11/674,004

(22) Filed: Feb. 12, 2007

(65) Prior Publication Data

US 2007/0183148 A1 Aug. 9, 2007

Related U.S. Application Data

(63) Continuation-in-part of application No. 10/970,615, filed on Oct. 21, 2004, now Pat. No. 7,229,192, and a continuation-in-part of application No. 10/970,625, filed on Oct. 21, 2004, now Pat. No. 7,261,435.

(60) Provisional application No. 60/580,996, filed on Jun. 18, 2004.

(51) Int. Cl.
*F21V 7/00* (2006.01)

(52) U.S. Cl. ..... 362/299; 362/260; 362/147; 362/217

(58) Field of Classification Search ..... 362/147, 362/296–299, 301, 303, 341, 347, 260, 217
See application file for complete search history.

(56) References Cited

U.S. PATENT DOCUMENTS

| | | | | | |
|---|---|---|---|---|---|
| 2,334,005 | A * | 11/1943 | Hoeveler | ..... | 362/223 |
| 4,135,228 | A * | 1/1979 | Lones | ..... | 362/18 |
| 4,498,126 | A * | 2/1985 | Hernandez | ..... | 362/220 |
| 5,055,976 | A * | 10/1991 | Arai | ..... | 362/17 |
| 5,746,522 | A * | 5/1998 | Moreland | ..... | 400/197 |
| 5,803,588 | A * | 9/1998 | Costa | ..... | 362/223 |
| 5,988,829 | A * | 11/1999 | Holder | ..... | 362/217 |
| 6,789,914 | B1 * | 9/2004 | Brown et al. | ..... | 362/147 |

* cited by examiner

*Primary Examiner*—Ali Alavi
(74) *Attorney, Agent, or Firm*—Ballard Spahr Andrews & Ingersoll, LLP

(57) ABSTRACT

A light fixture or troffer for directing light emitted from a light source toward an area to be illuminated, including a reflector assembly within which the light source is positioned, a lens assembly detachably secured to a portion of the reflector assembly such that a lens of the lens assembly overlies a portion of the light source, and a plurality of end caps secured to a housing of the light fixture and overlying a portion of the light source such that substantially all of the light emitted from the light source passes through the lens assembly and the end caps.

40 Claims, 12 Drawing Sheets

LIGHT FIXTURE

This application is a continuation in part application of U.S. patent application Ser. No. 10/970,615, filed on Oct. 21, 2004 now U.S. Pat. No. 7,229,192, and Ser. No. 10/970,625, filed on Oct. 21, 2004, now U.S. Pat. No. 7,261,435, which claim priority to U.S. provisional patent application 60/580,996, filed on Jun. 18, 2004, all of which are incorporated in their entirety by reference herein.

FIELD OF THE INVENTION

The present invention generally relates to light fixtures for illuminating architectural spaces. The invention has particular application in light fixtures using fluorescent lamps, such as the T5 linear fluorescent lamp, as the light source.

BACKGROUND ART

Numerous light fixtures for architectural lighting applications are known. In the case of fixtures that provide direct lighting, the source of illumination may be visible in its entirety through an output aperture of the light fixture or shielded by elements such as parabolic baffles or lenses. A light fixture presently used in a typical office environment comprises a troffer with at least one fluorescent lamp and a lens having prismatic elements for distributing the light. Also known are light fixtures that use parabolic reflectors to provide a desired light distribution. The choice of light fixture will depend on the objectives of the lighting designer for a particular application and the economic resources available. To meet his or her design objectives, the lighting designer, when choosing a light fixture, will normally consider a variety of factors including aesthetic appearance, desired light distribution characteristics, efficiency, lumen package, maintenance and sources of brightness that can detract from visual comfort and productivity.

An important factor in the design of light fixtures for a particular application is the light source. The fluorescent lamp has long been the light source of choice among lighting designers in many commercial applications, particularly for indoor office lighting. For many years the most common fluorescent lamps for use in indoor lighting have been the linear T8 (1 inch diameter) and the T12 (1½ inch diameter). More recently, however, smaller diameter fluorescent lamps have become available, which provide a high lumen output from a comparatively small lamp envelope. An example is the linear T5 (⅝ inch diameter) lamp manufactured by Osram/Sylvania and others. The T5 has a number of advantages over the T8 and T12 , including the design of light fixtures that provide a high lumen output with fewer lamps, which reduces lamp disposal requirements and has the potential for reducing overall costs. The smaller-diameter T5 lamps also permit the design of smaller light fixtures.

Some conventional fluorescent lamps, however, have the significant drawback in that the lamp surface is bright when compared to a lamp of larger diameter. For example, a conventional T5 lamp can have a surface brightness in the range of 5,000 to 8,000 footlamberts (FL), whereas the surface brightness of the larger T8 and T12 lamps generally is about 3,000 FL and 2,000 FL, respectively (although there are some versions of linear T8 and T12 lamps with higher brightness). The consequence of such bright surfaces is quite severe in applications where the lamps may be viewed directly. Without adequate shielding, fixtures employing such lamps are very uncomfortable and produce direct and reflected glare that impairs the comfort of the lighting environment. Heretofore, opaque shielding has been devised to cover or substantially surround a fluorescent lamp to mitigate problems associated with light sources of high surface brightness; however, such shielding defeats the advantages of a fluorescent lamp in regions of distribution where the lamp's surfaces are not directly viewed or do not set up reflected glare patterns. Thus, with conventional shielding designs, the distribution efficiencies and high lumen output advantages of the fluorescent lamp can be substantially lost.

A further disadvantage to traditional parabolic and prismatic troffers is the presence of distracting dynamic changes in brightness level and pattern as seen by a moving observer in the architectural space. Additionally, traditional parabolic and prismatic troffers allow direct or only slightly obscured views of the lamp source(s)) at certain viewing angles (low angles for both the parabolic and prismatic and most transverse angle for prismatic). This unaesthetic condition is remedied by indirect and direct-indirect fixture designs, but typically with a significant loss of efficiency.

Another known solution to the problem of direct glare associated with the use of high brightness fluorescent lamps is the use of biax lamps in direct-indirect light fixtures. This approach uses high brightness lamps only for the uplight component of the light fixture while using T8 lamps with less bright surfaces for the light fixture's down-light component. However, such design approaches have the drawback that the extra lamps impair the designer's ability to achieve a desired light distribution from a given physical envelope and impose added burdens on lamp maintenance providers who must stock and handle two different types of lamps.

Conventional parabolic light fixture designs have several negative features. One of these is reduced lighting efficiency. Another is the so-called "cave effect," where the upper portions of walls in the illuminated area are dark. In addition, the light distribution of these fixtures often creates a defined line on the walls between the higher lit and less lit areas. This creates the perception of a ceiling that is lower than it actually is. Further, when viewed directly at high viewing angles, a conventional parabolic fixture can appear very dim or, even, off.

The present invention overcomes the above-described disadvantages of light fixtures using brighter light sources by providing a configuration that appears to a viewer as though it has a source of lower brightness, but which otherwise permits the light fixture to advantageously and efficiently distribute light generated by the selected lamp, such as the exemplified T5 lamp. The light fixture of the present invention reduces distracting direct glare associated with high brightness light sources used in direct or direct-indirect light fixtures.

SUMMARY OF THE INVENTION

The present invention relates to a light fixture, or troffer, for efficiently distributing light emitted by a light source into an area to be illuminated. In one general aspect of the invention, the light fixture includes a reflector assembly that supports the light source. The light fixture may also include a lens assembly and end caps that are positioned with respect to a portion of the reflector assembly to receive light emitted by the light source and distribute it such that glare is further reduced. In a preferred embodiment, the lens assembly and the respective end caps of the light fixture receive and distribute substantially all of the light emitted by the light source.

In one aspect, the reflector assembly of the light fixture includes a base member that extends longitudinally between spaced edges along a longitudinal axis. In one aspect, at least a portion of the base member can form a reflective surface. In one aspect, the reflector assembly supports the light source such that the light source longitudinal axis is substantially parallel to that of the base member.

In another aspect, the lens assembly includes a lens that has a first end edge, an opposed second end edge, and a central lens portion that extends longitudinally between the first and second end edges. In one aspect, the lens has a lens longitudinal axis that is generally parallel to the light source longitudinal axis. In one aspect, the central portion of the lens has a prismatic surface that defines a face that can be oriented toward or away from the light source. In one aspect, the central lens portion is curved and can have a concave, convex, or planar shape in cross-section.

In an alternative aspect, the lens assembly may include a diffuser inlay that is positioned in substantially overlying registration with a portion of the face of the central lens portion that faces the light source. The lens is preferably detachably secured to a portion of the reflector assembly in overlying registration with the light source. In operation, the lens assembly of the present invention provides an aesthetically more pleasing appearance as well as efficiently distributing the light generated by the light source onto portions of the reflective surfaces of the reflector assembly and onto the desired area to be illuminated.

In another aspect, the light fixture includes a pair of opposed end caps. Each end cap is mountable to one of the respective ends of the light fixture. In a further aspect, each end cap can be formed of an at least partially light transmissive material such that a portion of the light produced by the light source is diffused therethrough the end caps. Thus, in operation, the end caps can appear illuminated. In one exemplary aspect, the end caps would be illuminated at substantially the same light intensity as the light passing therethrough the lens. In yet another aspect, the respective longitudinal end edges of the lens can be configured to be positioned in close proximity to the first faces of the respective end caps.

In one embodiment of the present invention, a plurality of light fixtures can be positioned adjacent to each other substantially coaxially. In this aspect, the aligned light fixtures appear to an external viewer as a substantially unitary light fixture.

BRIEF DESCRIPTION OF THE FIGURES

These and other features of the preferred embodiments of the invention will become more apparent in the detailed description in which reference is made to the appended drawings wherein.

DETAILED DESCRIPTION OF THE INVENTION

Figure 1:
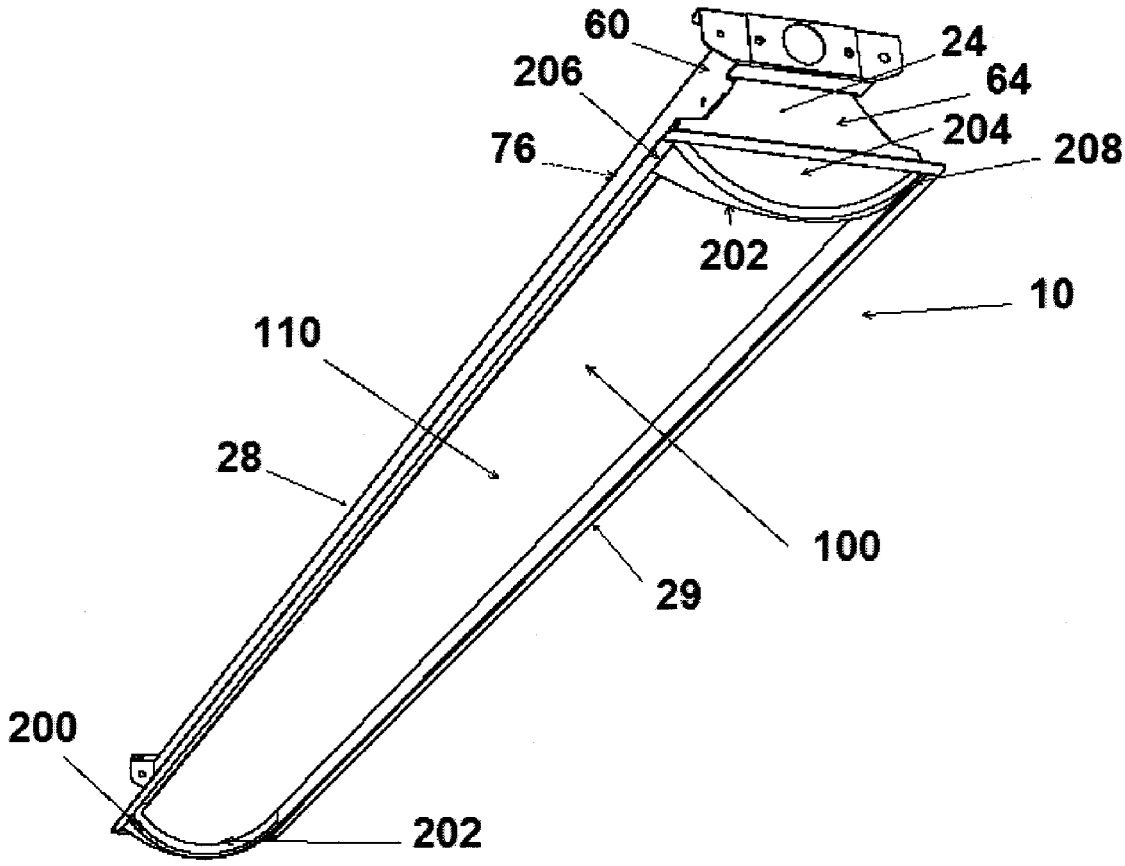
FIG. 1 is a perspective view of one embodiment of a light fixture of the present invention, showing a lens assembly mounted thereto.
Figure 2:
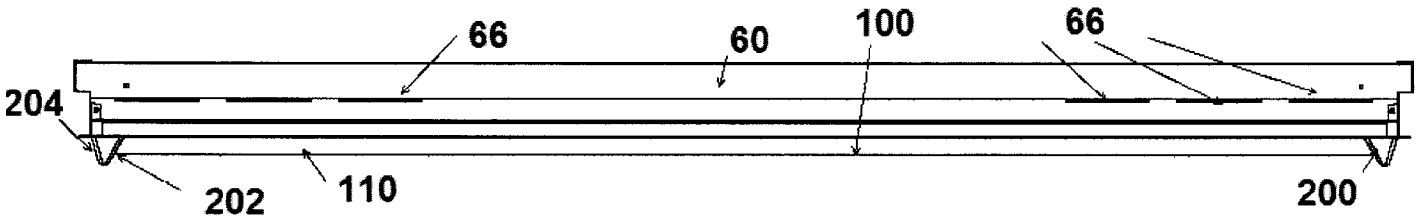
FIG. 2 is a side elevational view of the light fixture of FIG. 1.
Figure 3:
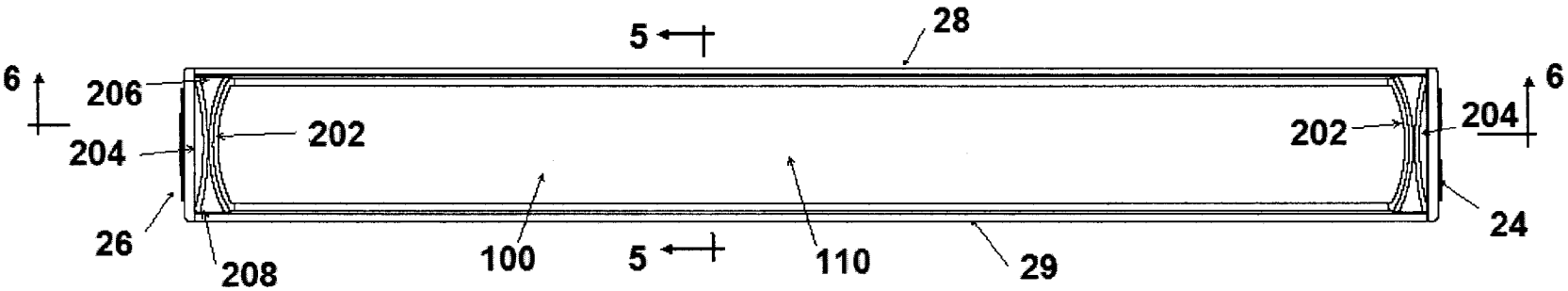
FIG. 3 is a bottom elevational view of the light fixture of FIG. 1.
Figure 4:
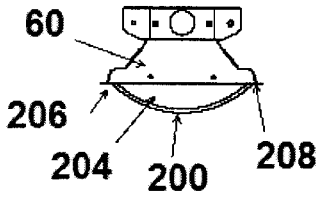
FIG. 4 is an end elevational view of the light fixture of FIG. 1.
Figure 5:
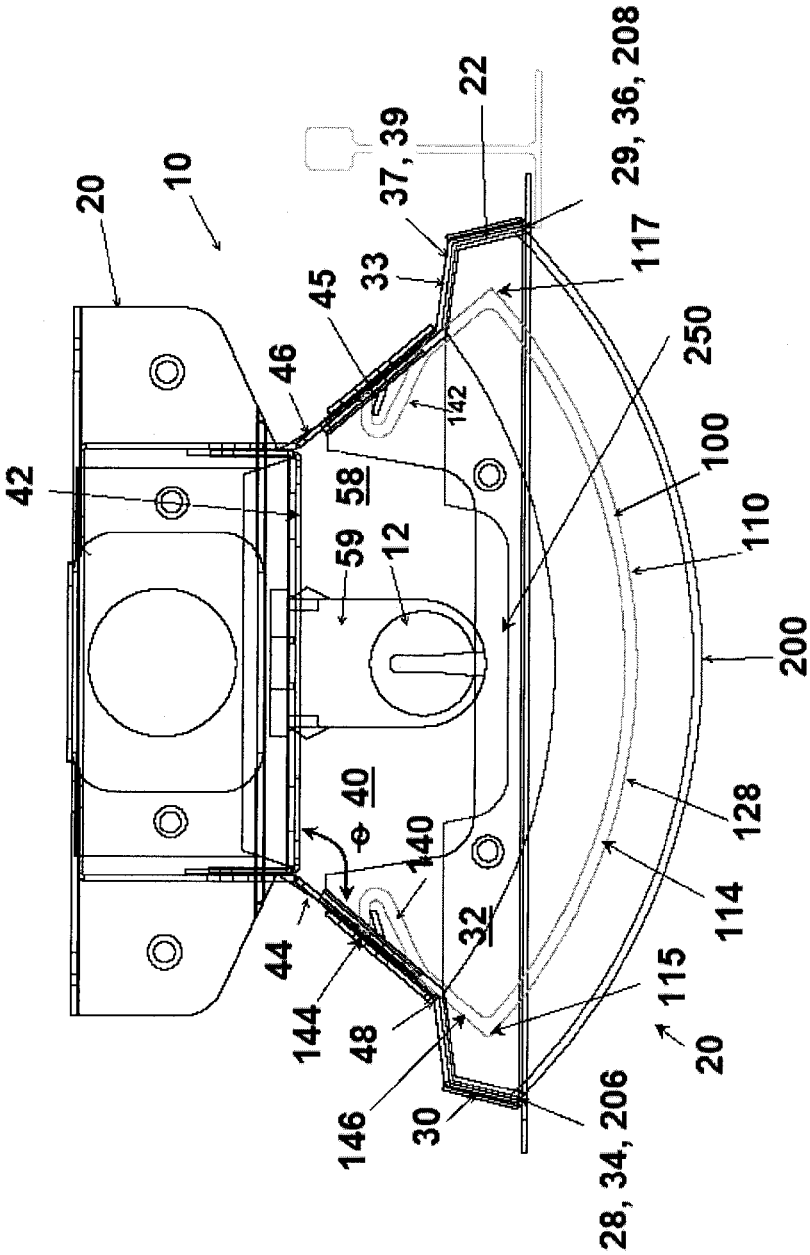
FIG. 5 is a cross-sectional view of the light fixture of FIG. 3 taken across line 5-5, showing a single light source mounted therein.
Figure 6:
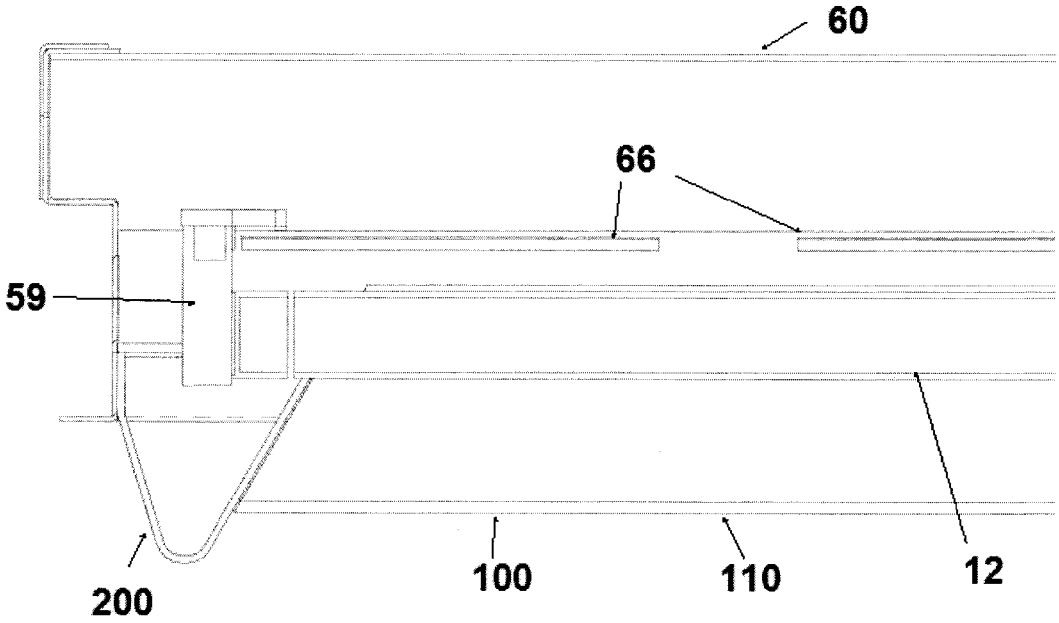
FIG. 6 is a partial cross-sectional view of the light fixture of FIG. 3, taken across line 6-6.

The present invention is more particularly described in the following exemplary embodiments that are intended as illustrative only since numerous modifications and variations therein will be apparent to those skilled in the art. As used herein, "a," "an," or "the" can mean one or more, depending upon the context in which it is used. The preferred embodiments are now described with reference to the figures, in which like reference characters indicate like parts throughout the several views.

Ranges may be expressed herein as from "about" one particular value, and/or to "about" another particular value. When such a range is expressed, another embodiment includes from the one particular value and/or to the other particular value. Similarly, when values are expressed as approximations, by use of the antecedent "about," it will be understood that the particular value forms another embodiment.

Referring to FIGS. 1-6, a light fixture 10 or troffer of the present invention for illuminating an area includes a reflector assembly 20 for housing a linear light source 12. The light source extends along a light source longitudinal axis between a first end of the light source and a spaced second end thereof.

Light emanating from the light source 12 is diffused by a lens assembly 100 that is positioned between the light source 12 and the area to be illuminated. The light source 12 may be a conventional fluorescent lamp, and in one aspect, the light source 12 can be a conventional T5 lamp.

The reflector assembly 20 of the light fixture includes an elongated base member 22 that has a first end edge 24, a spaced second end edge 26, a first longitudinally extending side edge 28 and an opposed second longitudinally extending side edge 29. The base member 22 further has a base surface 30 extending along a base longitudinal axis. The base member can be formed from a single piece of material or from a plurality of adjoined pieces. As one will appreciate, the reflector assembly can be formed from any code-compliant material. For example, the base member can be formed from steel.

A portion of the base surface 30 of the base member 22 forms a longitudinally extending hollow 32 that extends inwardly in the transverse dimension with respect to and away from the respective first and second longitudinally extending side edges. The hollow 32 extends inwardly to a central portion 38 defined by and between respective first and second hollow edges 34, 36. The central portion defines a longitudinally extending trough 40 that extends inwardly away from the surface of the hollow 32. At least a portion of each hollow 32 preferably forms a reflective surface 33 extending between central portion 38 and a respective one of the first and second hollow edges 34, 36. In one embodiment, at least a portion of a section of each hollow 32 normal to the base longitudinal axis can have a generally curved shape such that such that portions of the hollow 32 form a generally curved reflective surface for diffusely reflecting light received from the lens into the architectural space in a desired pattern. In an alternative embodiment, a portion of each hollow 32 can have at least one planar portion.

In one aspect, at least a portion of the hollow of the base surface 30 of the base member can be painted or coated with a reflective material or formed from a reflective material. The reflective material may be substantially glossy or substantially flat. In one example, the reflective material is preferably matte white to diffusely reflect incident light.

In one aspect, at least a portion of the base surface 30 of the base member 22 has a plurality of male ridges 37 formed thereon that extend longitudinally between the ends of the base member. In an alternative aspect, at least a portion of the base surface 30 of the base member has a plurality of female grooves 39 formed thereon that extend longitudinally between the ends of the base member. Alternatively, the ridges or grooves extend at an angle to the longitudinal axis of the base member. For example, the male ridges or female grooves may extend transverse to the base longitudinal axis (i.e., extending between the respective first and second longitudinally extending side edges 28, 29 of the base member). In one example, at least a portion of the reflective surface 33 of the hollow 32 has the plurality of male ridges 37 formed thereon. In an alternative example, at least a portion of the reflective surface 33 of the hollow 32 has the plurality of female grooves 39 formed therein. In another aspect, each male ridge or female groove 37, 39 can extend substantially parallel to an adjoining male ridge or female groove. The ridges 37 or grooves 39 formed on the hollow 32 provide a diffusely reflecting surface.

Figure 7:
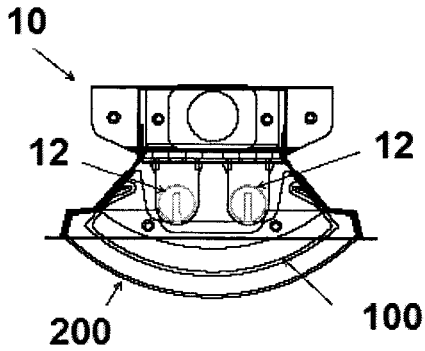
FIG. 7 is an exemplified transverse cross-sectional view of a light fixture of FIG. 1, showing a pair of longitudinally extending light sources mounted therein.
Figure 8:
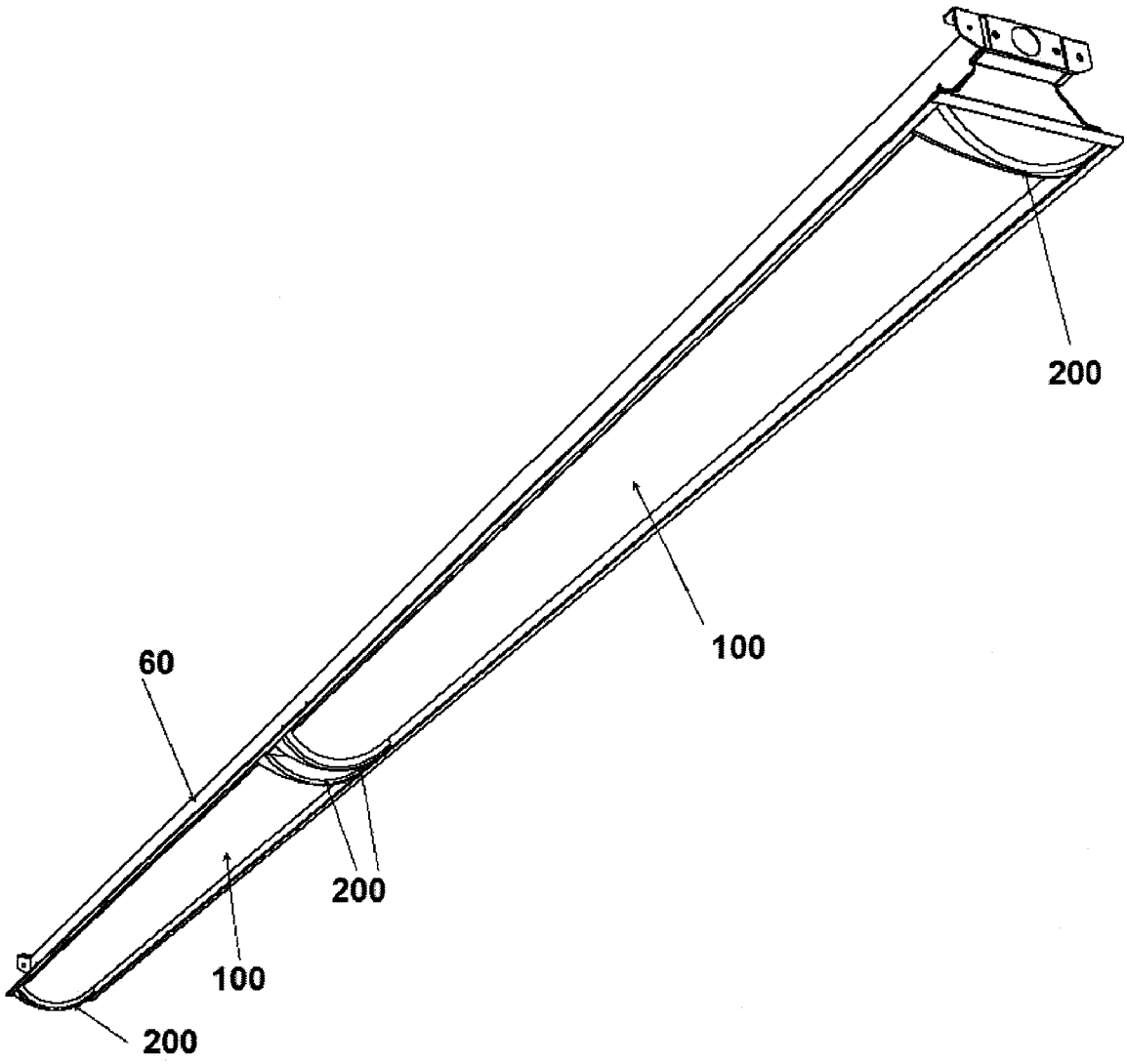
FIG. 8 is a perspective view of one embodiment of the light fixture of the present invention.
Figure 9:
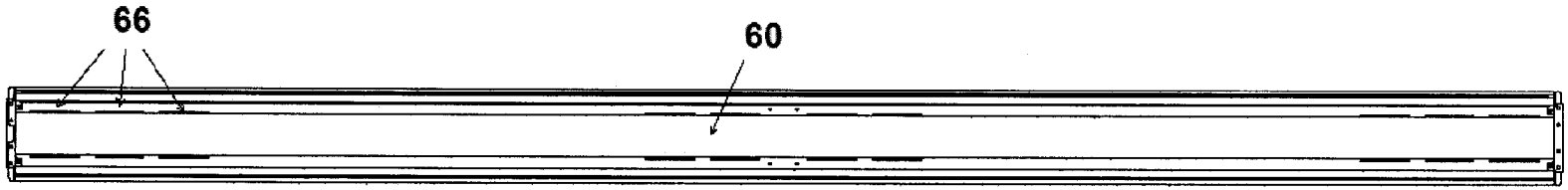
FIG. 9 is a top elevational view of the light fixture of FIG. 8.
Figure 10:
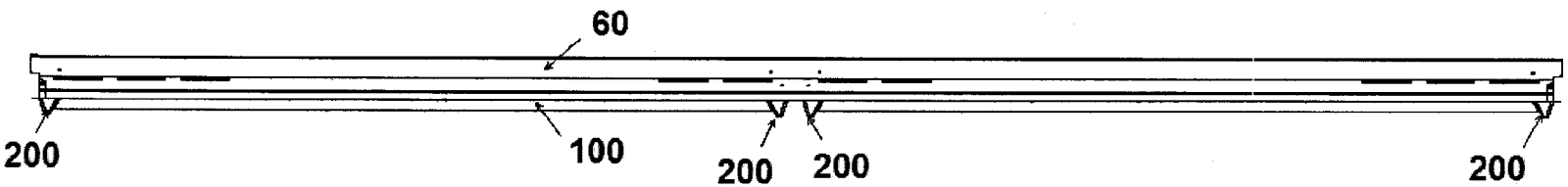
FIG. 10 is a side elevational view of the light fixture of FIG. 8.
Figure 11:
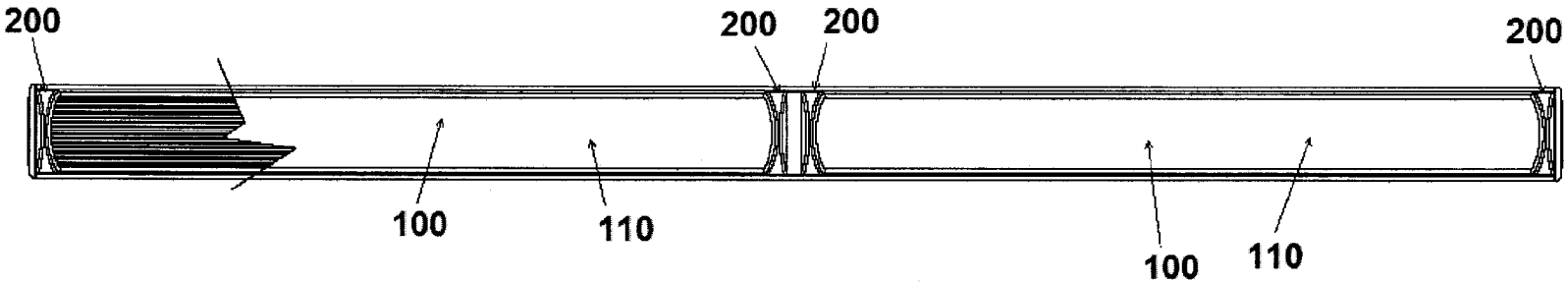
FIG. 11 is a bottom perspective view of the light fixture of FIG. 8.
Figure 12:
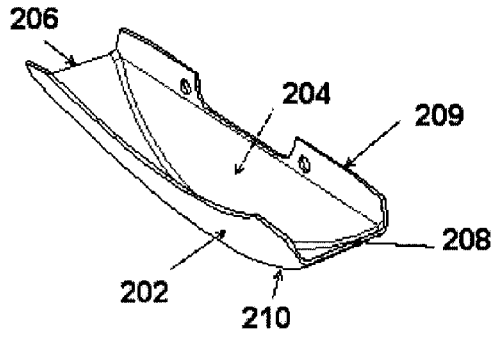
FIG. 12 is a top perspective view of a first embodiment of an end cap of the light fixture.
Figure 13:
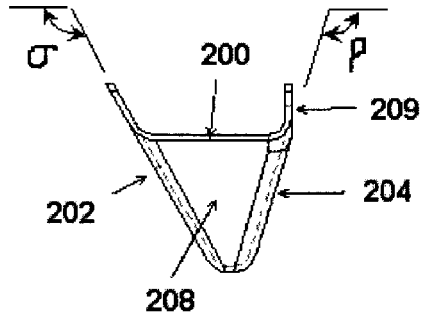
FIG. 13 is a side elevational view of the end cap of FIG. 12.
Figure 14:
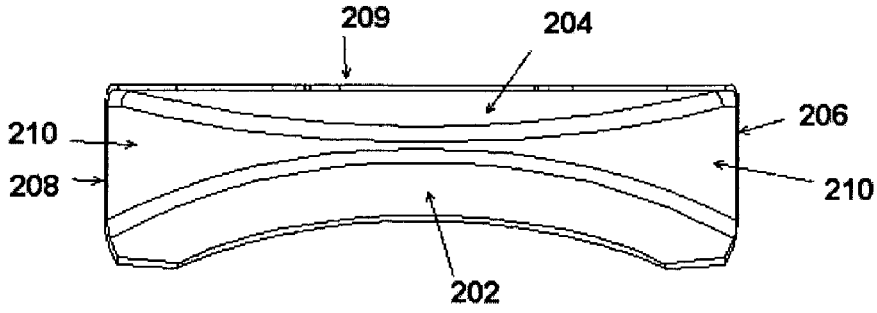
FIG. 14 is a bottom perspective view of the end cap of FIG. 12.
Figure 15:
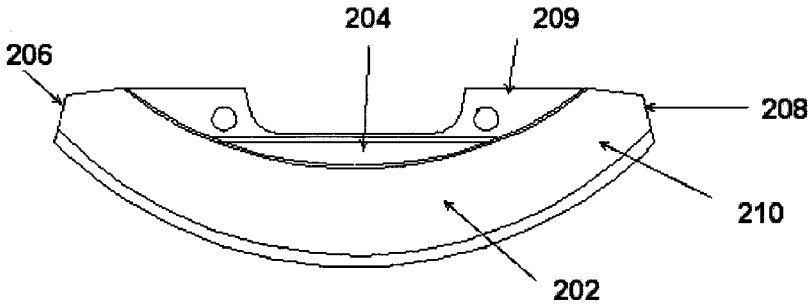
FIG. 15 is a front side elevational view of the end cap of FIG. 12.
Figure 16:
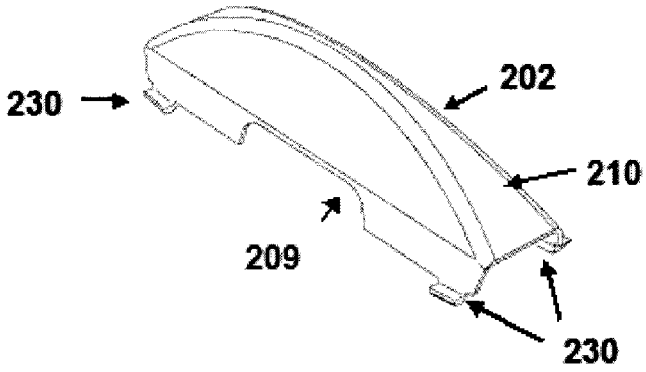
FIG. 16 is a top perspective view of a second embodiment of an end cap of the light fixture, showing a plurality of tabs that are configured to releasably mount therein defined slots in the light fixture.
Figure 17:
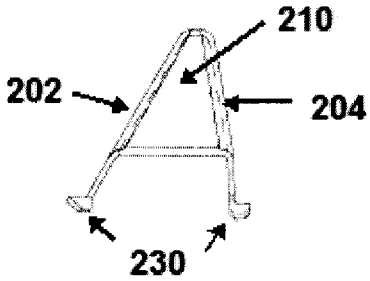
FIG. 17 is a side elevational view of the end cap of FIG. 16.
Figure 18:
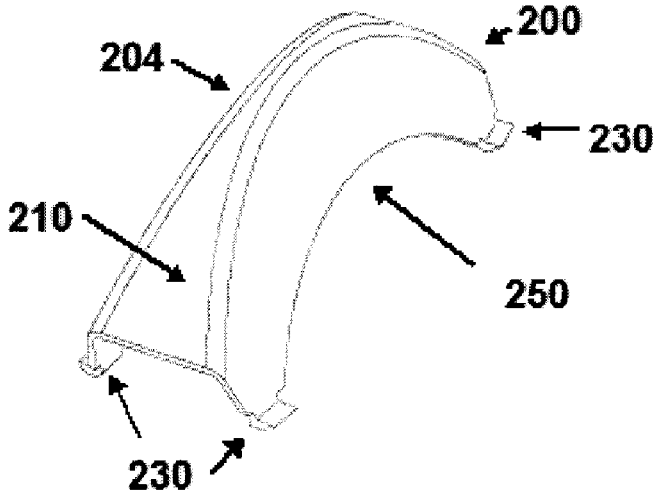
FIG. 18 is a bottom side perspective view of the end cap of FIG. 16.
Figure 19:
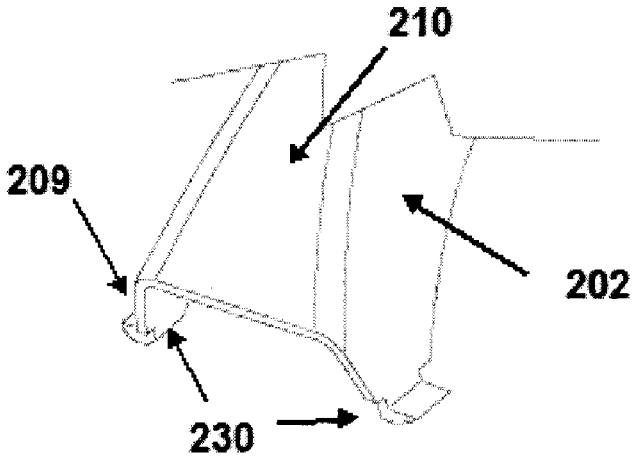
FIG. 19 is an enlarged view of a top portion of the end cap of FIG. 18 showing two of the plurality of tabs extending therefrom the top portions of the end cap.
Figure 20:
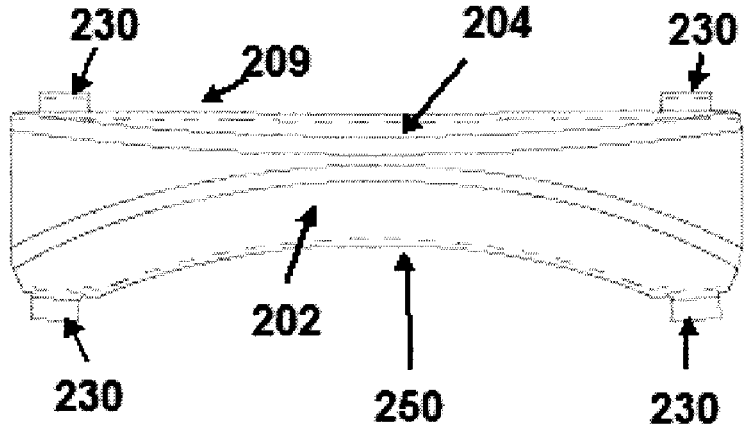
FIG. 20 is a bottom elevational view of the end cap of FIG. 16.
Figure 21:
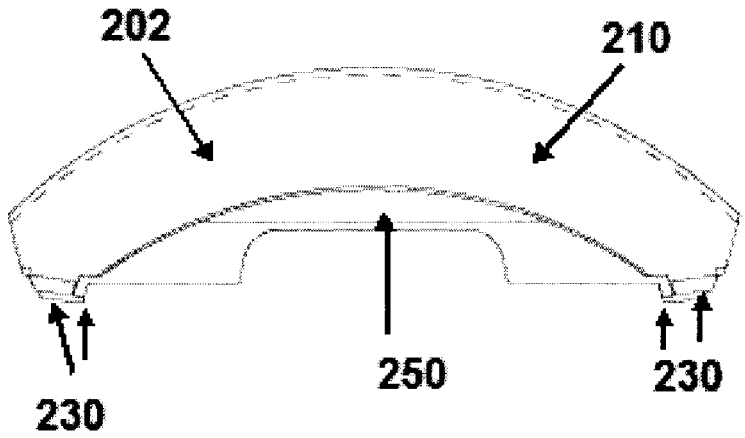
FIG. 21 is a front side elevational view of the end cap of FIG. 16.
Figure 22:
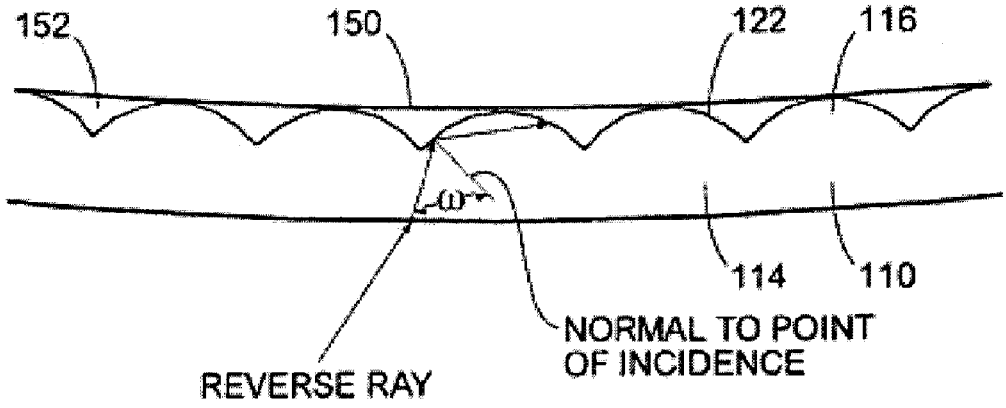
FIG. 22 shows an exemplary path of a reverse ray of light, in a vertical plane transverse to the longitudinal axis of the light fixture, entering the face of the lens, the face being oriented away from the light source.
Figure 23:
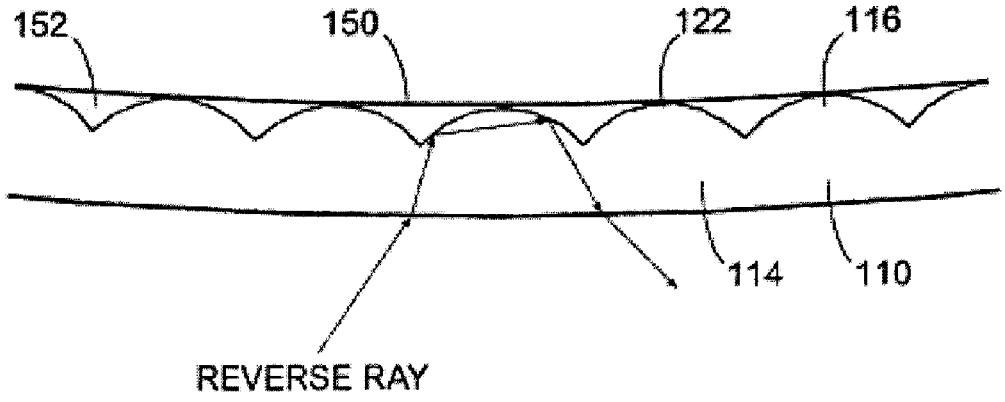
FIG. 23 shows an exemplary path of a reverse ray of light, in a vertical plane transverse to the longitudinal axis of the light fixture, being rejected out of the face of the lens, the face being that is oriented away from the light source.
Figure 24:
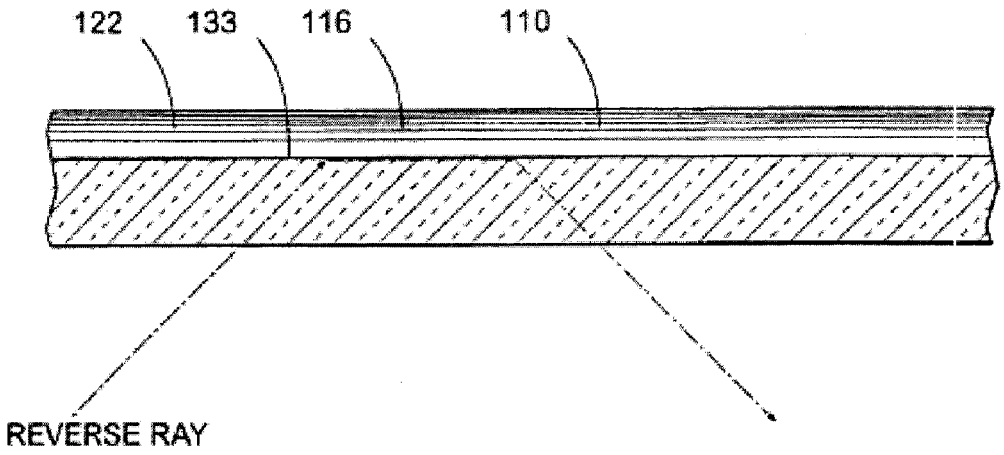
FIG. 24 shows an exemplary path of a reverse ray of light, in a vertical plane parallel to the longitudinal axis of the light fixture, entering the face of the lens and being rejected out of the face of the lens, the face being oriented away from the light.
Figure 25:
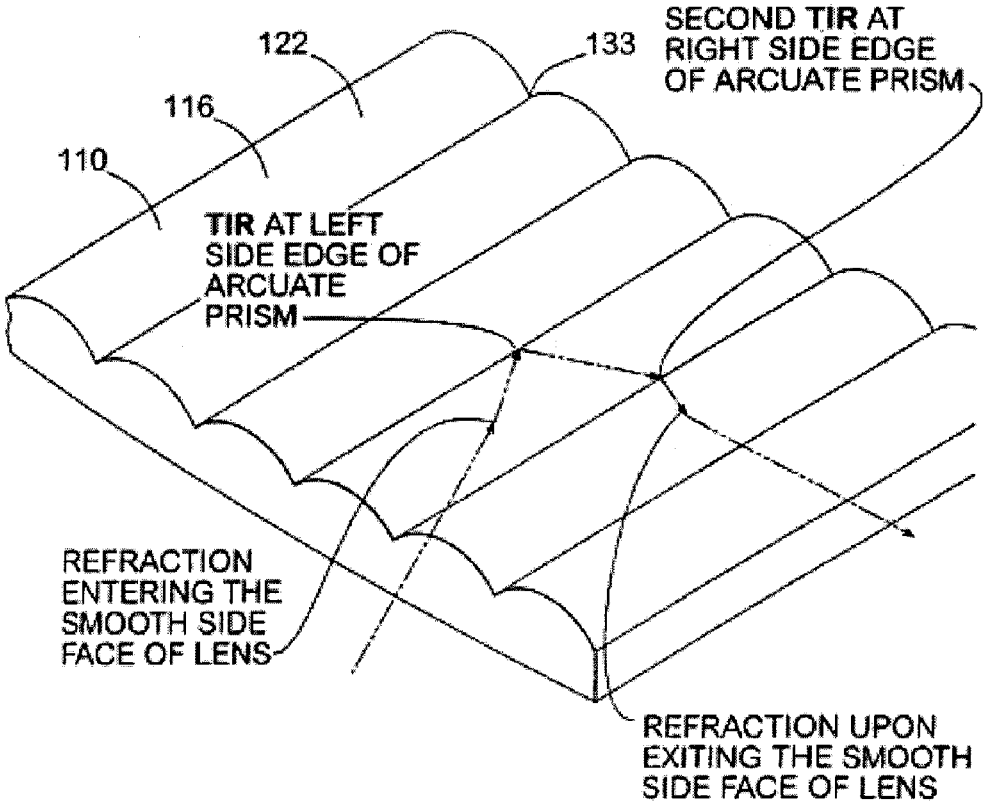
FIG. 25 is a perspective view of the exemplary path of a reverse ray of light.

The central portion 38 of the light fixture is preferably symmetrically positioned with respect to the first and second hollow edges 34, 36. In one aspect, and as exemplarily shown in FIG. 7, the central portion of the light fixture can be configured to accept one, two, or more light sources therein. In a further aspect, a trough 40 formed by a top surface 42, a first side trough surface 44 and an opposed second side trough surface 46 is provided for receiving the elongated light source 12. Each respective first and second side trough surface has a lower edge 48 that is integral with a portion of adjoined hollow 32. In one example, the lower edges of first and second trough surfaces are integral with the reflective surfaces 33 of the adjoined hollow. Each respective first and second side trough surfaces defines a trough surface axis that extends in a vertical plane normal to the base longitudinal axis of the base member. In an additional aspect of the invention, the light source 12 can be positioned within the trough of the reflector assembly such that at least a portion of the light source is positioned substantially about or above the plane that extends between the lower edges 48 of the respective first and second trough surfaces 44, 46.

In one aspect, the trough surface axis of each of the first and second trough surfaces 44, 46 respectively forms an angle θ of about and between about 140° to 90° with respect to the top surface 42 of the trough. More particularly, the angle θ can be about and between about 135° to 95° with respect to the top surface of the trough. Still more particularly, the angle θ can be about and between about 130° to 100° with respect to the top surface of the trough. In another aspect, the angle θ formed between each of the respective first and second trough surfaces and the top surface of the trough can be substantially equal.

The light fixture 10 of the present invention also includes a housing 60 having a first end wall 62 and a second end wall 64. In one aspect, the first end wall 62 is connected to a portion of the first end edge 24 of the base member 22 and the second end wall is connected to a portion of the second end edge 26 of the base member 22. In another aspect, and as one skilled in the art will appreciate, at least a portion of the housing 60 can form portions of the base member 22, such as and not meant to be limiting, the base surface 30.

In one embodiment of the present invention, the light fixture 10 of the present invention comprises at least two opposed end caps 200. Each end cap has a first face 202, an opposed second face 204, a first side edge 206 and an opposed second side edge 208. In one aspect, the first face 202 extends therebetween the first side edge and the second side edge and is configured to be positioned at a first obtuse angle σ with respect to the longitudinal axis of the base member. In one aspect, the first obtuse angle σ can range from between about 130 to 170 degrees, with additional angles including 132, 134,136, 138, 140,142,144,146, 148,150, 152,154,156, and 158 degrees. In a further aspect, at least a portion of the first face 202 can have an arcuate shape. In this aspect, it is contemplated that the arcuate shape can form a substantially concave surface. It is also contemplated that at least a portion of the first face can be substantially planar.

In a further aspect, the second face 204 of each end cap 200 extends therebetween the first side edge and the second side edge and is configured to be positioned at a second obtuse angle ρ with respect to the longitudinal axis of the base member. In one exemplary aspect, the second obtuse angle ρ is less than the first obtuse angle σ. In this aspect, the second obtuse angle ρ can range from between about 90 to 150 degrees, with additional angles including 92, 94, 96, 98, 100, 102,104, 106,108, 110,112,114, 116,118, 120,122,124, 126, 128,130,132, 134,136,138, 140,142, 144,146 and 148 degrees. In another aspect, and similar to the first face, at least a portion of the second face 204 can have an arcuate shape. In this aspect, it is contemplated that the arcuate shape can form a substantially concave surface. It is also contemplated that at least a portion of the second face can be substantially planar.

In yet another aspect, and as shown in FIGS. 12-15, the second face of the end cap can have a mount portion 209 that is configured to be mounted to the light fixture. In one aspect, the mount portion can be configured for mounting to the respective end walls of the housing such that portions of the first and second faces of the end cap overlie portions of the trough of the reflector assembly. It is also contemplated that the end caps could be mounted to portions of the base member as desired. Optionally, and as shown in FIGS. 16-21, the end cap can have a plurality of tabs 230 that are configured to selectively connect to complementary slots defined therein the light fixture. In one exemplary aspect, the plurality of tabs 230 can comprise a pair of spaced tabs that extend outward therefrom the top portion, preferably the top edge portion, of the first face 202 and a pair of space tabs that extend therefrom the top portion, preferably the top edge portion, of the mount portion 209.

In operation, it is contemplated that the end caps 200 can be configured to be positioned therein the reflector assembly such that the edge portions 210 of the end caps are in substantial overlying registration with portions of the reflective surface 33. In one aspect, the edge portions 210 are positioned in contact with a portion of the reflective surface 33. When positioned therein the reflector assembly, it is contemplated that respective first faces 202 of opposing end caps will be positioned such that they are in opposition to each other. Further, if the light fixtures 10 are mounted adjacent to each other along a common fixture axis, the respective second faces 204 of adjacent end caps are be positioned such that they are in opposition to each other.

In one aspect, the end caps 200 can be formed of an at least partially light transmissive material, such as, for example and not meant to be limiting, glass or a polymer. In one exemplary aspect, the end caps are formed of an acrylic material. In another aspect, the light transmissive material can be colored. In another aspect, portions of the outer surface of the end caps can have a smooth or matte finish.

As one skilled in the art will appreciate, in operation, the respective end caps 200 are illuminated by the light source 12 mounted therein the trough 40 and some of the light that impacts the inner surface of the end caps is allowed to transmit therethrough the end caps. In one aspect, the end caps 200 allow transmission of between about 60 and 90 percent of the light that impacts on the inner surface of the respective end caps, including additional percentages of 65, 70, 75, 80 and 85percent, with a preferred range of between about 70 and 80 percent. In one aspect, the light intensity of the end caps can be selected to substantially equal the light intensity of the lens assembly. In this exemplary aspect, the respective lens assembly and end caps can visually form a source of light that appears substantially continuous and of a substantially uniform intensity.

In a further aspect, the respective end caps 200 can optically alter the apparent perspective of the light fixture and aesthetically give the light fixture a deeper appearance. Further, and referring to FIGS. 8-11, one elongate fixture can exemplarily comprise a plurality of pairs of end caps. In this example, two end caps are positioned at the respective ends of the light fixture and two are positioned substantially in the center of the light fixture. One skilled in the art will appreciate that, in this configuration, the light fixture 10 gives the appearance of two light fixtures being mounted together along a common light fixture axis.

In one aspect, when mounted to the light fixture, each of the end caps 200 define an opening 250 that is constructed and arranged to receive at least a portion of a selected end 14, 16 of the light source 12. In this aspect, portions of the end caps, portions of the respective first and second end walls of the housing, and portions of the base surface each define a chamber 58 which can be configured to receive at least a portion of a selected end of the light source therein.

In one aspect, each chamber 58 is configured to mount an electrical contact 59 or receptacle for detachably securing a selected end of the light source thereto. In one example, the electrical contact 59 is mounted onto a portion of the base surface 30 of the base member 22 that partially defines the chamber 58. It is contemplated that the electrical contact 59 can be mounted to any of the surfaces that define the chamber 58.

In a further aspect, the housing of the light fixture can also include a plurality of slots 66 that are in communication with the interior chamber formed by the enclosure of the light source 12 by the lens assembly and the end caps. The slots 66 provide a means for venting air from the interior chamber that has been heated by the illumination of the light source. The housing can also further define a ballast enclosure that is configured to accept at least one conventional light ballast that is in electrical communication with an external power source. In one aspect, the at least one ballast is positioned within the interior of the ballast enclosure.

In an alternative embodiment, the light fixture can be suspended from the ceiling. In this aspect, the reflector assembly can be connected to a housing that defines an interior cavity sized to accept the electrical ballast therein. The housing is spaced from the ceiling a predetermined distance and is mounted to the ceiling via conventional suspension means. Alternatively, the ballast can be mounted onto a portion of the surface of the base member that is oriented towards the ceiling. In this aspect, the base member is spaced from the ceiling a predetermined distance and is mounted to the ceiling via conventional mounting means.

As discussed in applicants' co-pending U.S. patent application Ser. Nos. 10/970,615 and 10/970,625, the disclosures of which are incorporated herein in their entireties by this reference, the lens assembly 100 of the present invention is constructed and arranged to direct light emitted by the light source 12 onto the area to be illuminated. A basic function of the lens assembly 100 is to diffuse the light from the light source 12 to effectively hide the light source 12 itself from view while reducing its brightness. Thus, one function of the lens assembly is to effectively become the source of light for the light fixture. This is accomplished in the preferred embodiment by providing the lens 110 of the lens assembly with an array of longitudinally extending prismatic elements 122 with short focal lengths. Because of the short focal lengths of the prismatic elements, the light from the light source is focused to parallel images very close to the surface of the lens at large angles of convergence. Because of the large angles of convergence, the images overlap and the light is essentially diffused. The diffused light is then either directed onto the surface to be illuminated without further reflection or is reflected by the reflective surfaces 33 of the hollow 32. Thus, the lens assembly provides a diffuse source of lowered brightness.

As discussed above, the light source 12 is mounted in the trough and is recessed with respect to the side edges of the reflector assembly. This allows the lens 110 to be placed higher in the light fixture and provides geometric control of high-angle rays emanating from the lens in the transverse direction. Thus, light rays produced at high viewing angles are physically blocked by the bottom longitudinally extending side edges 28, 29 of the light fixture, which prevents glare at high angles in that transverse direction. The light fixture of the invention controls glare in the longitudinal direction, however, optically.

High angle glare is reduced in the longitudinal direction as illustrated in FIGS. 22-25 and as described below. Thus, in this aspect, the light fixture of the invention prevents glare at high viewing angles through two mechanisms, geometrically in the transverse direction and optically in the longitudinal direction.

In one aspect, the lens assembly 100 includes a lens 110 having a first end edge 112, an opposed second end edge 113, and a central lens portion 114 that extends between the first and second edges. The central lens portion 114 has a lens longitudinal axis that extends between the first and second end edges. In one example, the lens longitudinal axis is generally parallel to the light source longitudinal axis. In one aspect, the respective longitudinal ends edges of the lens can be configured to be positioned in close proximity to the respective first faces of the end caps. In use, the lens 110 of the lens assembly is positioned with respect to the reflector assembly 20 and the end caps of the light fixture such that substantially all of the light emitted by the light source 12 passes through the lens 110 prior to impacting portions of the reflective surfaces 33 of the reflector assembly and/or prior to being dispersed into the surrounding area.

The lens 110 can be made from any suitable, code-compliant material such as, for example, a polymer or plastic. For example, the lens 110 can be constructed by extruding pellets of meth-acrylate or polycarbonates into the desired shape of the lens. The lens 110 can be a clear material or translucent material. In another aspect, the lens can be colored or tinted.

The central lens portion 114 of the lens has a prismatic surface 116 on a face 118 of the central lens portion that is either spaced from and facing toward the light source 12 or, alternatively, spaced from and facing away from the light source 12. In one aspect of the invention, the central lens portion 114 is curved in cross-section such that at least a portion of the face 118 of the central lens portion has a concave or convex shape relative to the light source. In an alternative embodiment, at least a portion of the central lens portion 114 is planar in cross-section.

In one aspect, at least a portion of the lens 110 is positioned within the reflector assembly so that it is recessed above a substantially horizontal plane extending between the first and second longitudinally extending side edges 28, 29 thereof.

In one aspect, the prismatic surface 116 of the lens defines an array of linearly extending prismatic elements 122. In one example, each prismatic element of the array can extend substantially longitudinally between the first and second end edges 112,113 of the lens. Alternatively, each prismatic element 122 of the array can extend linearly at an angle relative to the lens longitudinal axis. For example, each prismatic element thereof can extend generally transverse to the lens longitudinal axis. In a further aspect, each prismatic element 122 can have substantially the same shape or, alternatively, can vary in shape to cause differing visual effects on an external observer, lighting of the hollow surface, or light distribution to the room. In one aspect, each prismatic element has a portion that is rounded or has a curved surface.

In an additional aspect of the invention, the lens 110 of the light assembly 100 can be configured for detachable connection to the light fixture 10 or troffer. In one aspect, when positioned relative to the base member 22, the central lens portion 114 of the lens assembly can extend generally parallel to the light source longitudinal axis and generally symmetric about a plane that extends through the light source longitudinal axis. In one other aspect, the plane of symmetry extends through the area desired to be illuminated. In one example, the lens 110 is configured for detachable connection to a portion of the base surface 30 of the reflector assembly 20. In one particular example, the lens 110 is configured for detachable connection to a portion of the trough 20 defined in the base member 22.

In one aspect, the elongated lens 110 has a first arm 140 that is connected to a first lens edge 115 of the central lens portion 114 and a second arm 142 that is connected to a second lens edge 117 of the central lens portion 114. A portion of the each respective first and second arm 140, 142 is configured for being detachably secured to portions of the trough 40. In one example, a portion of the first arm 140 is configured for being detachably secured to a portion of the first side trough surface 44 and a portion of the second arm 142 is configured for being detachably secured to a portion of the second side trough surface 46.

In one example, each of the first and second side trough surfaces 44, 46 has at least one male protrusion 45, such as, for example, at least one tab, extending inwardly into the interior of the trough 40. Each of the first and second arms 140, 142 of the lens 110 has an end portion 144 that is sized and shaped for detachable engagement with the at least one male protrusion 45 in each of the respective first and second trough surfaces. Optionally, each of the first and second side surfaces 44, 46 can define at least one slot that is constructed and arranged to complementarily engage a male protrusion projecting from the end portion 144 of each of the respective first and second arms 140,142 of the lens.

In use, the lens 110 may be removed from the reflector housing by applying force to the respective first and second lens edges 115, 117 of the central lens portion 114. The application of force causes the central lens portion 114 to bend and, resultantly, causes the respective end portions 144 of the first and second arms 140,142 to move toward each other. Removal of the applied force allows the lens 110 to return toward its unstressed shape and allows the respective end portions 144 of the first and second arms 140, 142 to move away from each other.

In one aspect, each of the first and second arms of the lens has a bottom portion 146 that is connected to the respective first and second lens edges 115, 117 and extends toward the end portions 144 of the respective arms 140,142. The bottom portion 146 can be planar or non-planer in shape. In one example, the bottom portion 146 extends substantially between the first end edge 112 and the second end edge 113 of the lens.

In a further aspect, where the lens 110 is detachably secured to the trough 40 of the reflector assembly 20, a portion of the bottom portion 146 of each of the first and second arms of the lens is detachably positioned adjacent to a portion of the respective lower edges 48 of the first and second side trough surfaces 44, 46. Exemplarily, a portion of the bottom portion 146 of each of the first and second arms 140,142 of the lens 110 is positioned at an acute angle with respect to the reflective surface 33 of the hollow 32 adjacent the respective lower edge 48 of the first and second trough surfaces 44, 46. In this example, the portion of the bottom portion 146 of each of the first and second arms of the lens overlies a portion of the reflective surface 33 of the hollow 32 adjacent the respective lower edge 48 of the first and second trough surfaces. Here, the distance between the respective first and second lens edges 115,117 of the lens 110 is greater than the distance between the respective lower edges 48 of the first and second side trough surfaces 44, 46. In the embodiment described immediately above, each of the respective first and second lens edges 115, 117 is spaced from and overlies a portion of the reflective surfaces 33 of the hollow 32.

In one aspect, portions of the lens 110 that are positioned adjacent the surface of the reflective assembly 20 are configured to be in close overlying registration with portions of the reflector assembly when the lens 110 is detachably secured to the reflector assembly 20. For example, each of the respective first and second ends 112,113 of the lens are sized and shaped to be positioned adjacent to and in close overlying registration with portions of the reflector assembly 20 and with portions of the first faces 202 of the respective end caps 200. Thus, the light source 12 housed within the trough 40 of the reflector assembly 20 is substantially enclosed when the lens 110 and the end caps are detachably secured to the reflective assembly.

In one aspect, when the lens assembly is positioned within the reflector assembly, the light source is positioned below a plane bisecting the respective first or second longitudinally extending side edges 28, 29 of the base member 22. In another aspect, when the lens assembly is positioned within the reflector assembly, the light source can be positioned below, or substantially below, a plane bisecting the respective first or second lens edges 115,117.

The lens assembly 100 can also comprise a conventional diffuser inlay, such as, for example, a OptiGrafix™ film product, which is a diffuser film that can be purchased from Grafix® Plastics. The diffuser inlay can be pliable or fixed in shape, transparent, semi-translucent, translucent, and/or colored or tinted. In one example, the diffuser inlay has relatively high transmission efficiency while also scattering a relatively high amount of incident light to angles that are nearly parallel to its surface. In one aspect, the diffuser inlay is positioned between a portion of the face 118 of the central lens portion and the light source 12. In another aspect, the diffuser inlay is sized and shaped for positioning in substantial overlying registration with the portion of the face 118 of the central lens portion 114 that is oriented toward the light source.

The light fixture 10 of the present invention has a low height profile that allows for easy integration with other building systems and installations in low plenum spaces. In one aspect, the height profile of the light fixture is about or below 5 inches. More particularly, the height profile of the light fixture is about or below 4 inches. In another aspect, the height profile of the light fixture is about 3.25 inches.

In one embodiment of the lens assembly 100 discussed above, the central lens portion 114 of the lens 110 has a concave face 118 oriented toward the light source 12 when the lens 110 is detachably secured to and within a portion of the reflector assembly 20. The array of male rounded prismatic elements 122 can be extruded along the length of the lens 110. In use, the lens of the present invention design has a striped visual characteristic to an external observer when back lit. These "stripes" provide for visual interest in the lens 110 and may be sized and shaped to mirror any ridges or grooves disposed therein portions of the reflective surfaces 33 of the hollow 32 of the reflector assembly 20. The "stripes" also help to mitigate the appearance of the image of the lamp (the light source) by providing strong linear boundaries that breakup and distract from the edges of the lamp against the less luminous trough 40 of the reflector assembly 20. In addition, the "stripes" allow for the light fixture 10 of the present invention to provide high angle light control in vertical planes that are substantially parallel to the longitudinal axis of the light fixture.

In the preferred embodiment, the lens and the end caps essentially becomes the light source, which effectively reduces lamp brightness in both the transverse and longitudinal directions optically, to further reduce glare associated with lamps of high brightness.

Each rounded prismatic element 122 has a sufficiently large angular extent such that some total internal reflection at each common cusp edge is assured regardless of viewing angle. In one aspect, since each curved surface, or arcuate section 128 of each rounded prismatic element 122 is substantially circular, if a reverse ray undergoes total internal reflection at one portion of the arcuate section and is subsequently reflected to another portion of the arcuate section, then total internal reflection will also occur at the second point of incidence because the arcuate section's geometry causes both interactions to have substantially the same angle of incidence.

Generally then, a reverse ray that undergoes total internal reflection proximate a common cusp edge 133 will eventually exit the lens 110 out the same outer surface through which it entered the lens and will terminate on a surface or object in the room (as opposed to passing through the lens and terminating on the light source or the trough of the reflector assembly behind the lens). The reverse ray is said to be "rejected" by the lens. This means that the brightness an external viewer will perceive at the common cusp edge 133 of adjoining rounded prismatic elements 122 is the brightness associated with a room surface because any real/forward light ray impinging on the viewer's eyes from this part of the lens must have originated from the room or space. Generally, the brightness of an object or surface in the room is much lower than that of the light source or trough that is viewed through the central portions of the arcuate sections 128 of each prismatic element 122. This high contrast in brightness between the common cusp edge 133 between adjoining rounded prismatic elements 122 and the central portion of the arcuate sections 128 of each prismatic element 122 is so high that it is perceived, to the external viewer, as dark stripes on a luminous background.

The linear array of prismatic elements 122 of the lens assembly optically acts in the longitudinal direction to reduce high angle glare. This may be explained by considering a reverse ray that is incident on a portion of the prismatic surface of the lens proximate the common cusp edge 133 at the critical angle (the minimum angle of incidence $\omega$) for total internal reflection of the reverse ray. An observer viewing that portion of the lens (i.e., the portion of the area about the common cusp edge) would perceive it as being "dark" relative to that adjacent "bright" portion of the arcuate section proximate the rounded apex of each individual prismatic element. The array of linear elements thus optically controls the light emitted from the lamp in the longitudinal direction.

In one example, as the lens 110 is viewed at higher and higher viewing angles (as when the observer is further from the light fixture) in a vertical plane parallel or near parallel to the base longitudinal axis of the base member, the striping effect visible on the surface of the lens becomes more pronounced. This is a result of the increase in that portion of the prismatic surface of the lens that undergoes total internal reflection and creates the dark strips. This results from viewing the lens at angles greater than the critical angle for total internal reflection of a "reverse ray." Thus, the effective width of each stripe grows as the lens is viewed at higher viewing angles, which is observed as the lens becoming dimmer at higher viewing angles.

In one aspect, if the prismatic elements 122 are regularly spaced apart, the striping effect would also be regularly spaced. In another aspect, the prismatic elements 122 of the present invention can be sized and shaped to ensure some total internal reflection at all viewing angles so that the "striping" is perceptible at all viewing angles.

In use, normal movement of a viewer in the room does not change the viewer's vertical angle of view relative to the light fixture very rapidly and at far distances the stripes become less distinct. Therefore, the change is stripe width is not perceived as a dynamic motion but rather as a subtle changing of the overall lens brightness (i.e., brighter at low vertical angles and dimmer when viewed at high vertical angles).

The rounded or curved surface portions of each prismatic element 122 provide a wide spreading or diffusion of any incident light. The high degree of diffusion helps to obscure the image of the light source 12 as seen through the lens 110 even when the light source is in relatively close proximity to the face of the lens 110 that is oriented toward the light source. This becomes increasingly apparent as the lens is viewed at higher vertical angles in the vertical plane substantially parallel to the light source.

In another aspect, the rounded or curved surface portions of the prismatic elements 122 provide for a gradual change in the perceived brightness as a result of a change in the angle of view. In yet another aspect, in an embodiment of the invention in which each prismatic element 122 has substantially the same shape, the dark striping and the brighter areas of the lens 110 appear to change uniformly and smoothly from one prismatic element 122 to the next, adjoining prismatic element 122.

Although several embodiments of the invention have been disclosed in the foregoing specification, it is understood by those skilled in the art that many modifications and other embodiments of the invention will come to mind to which the invention pertains, having the benefit of the teaching presented in the foregoing description and associated drawings. It is thus understood that the invention is not limited to the specific embodiments disclosed hereinabove, and that many modifications and other embodiments are intended to be included within the scope of the appended claims. Moreover, although specific terms are employed herein, as well as in the claims which follow, they are used only in a generic and descriptive sense, and not for the purposes of limiting the described invention, nor the claims which follow.

What is claimed is:

1. A light fixture, comprising:

a reflector assembly comprising a longitudinally extending hollow extending inwardly to a central portion between the respective first and second hollow edges, a linear light source configured for mounting therein a portion of the central portion of the reflector assembly;

a lens assembly configured for mounting to a portion of the central portion of the reflector assembly, wherein the lens assembly overlies at least a portion of the linear light source; and a plurality of end caps configured for overlying a portion of the linear light source, wherein the lens assembly and the plurality of end caps are configured such that substantially all of the light emitted by the light source passes therethrough the lens assembly and the plurality of end caps, and wherein the lens assembly controls high angle glare in the longitudinal direction optically.

2. The light fixture of claim 1, wherein the plurality of end caps comprises at least two opposed end caps.

3. The light fixture of claim 1, wherein the reflector assembly further comprises an elongated base member having a first end edge, a spaced second end edge, and a base surface, the base longitudinal axis extending between the first and second end edges.

4. The light fixture of claim 3, wherein each end cap comprises a first face and an opposed second face.

5. The light fixture of claim 4, wherein each end cap further comprises a first side edge and an opposed side edge.

6. The light fixture of claim 5, wherein the first face extends substantially between the first side edge and the second side edge.

7. The light fixture of claim 4, wherein the first face is configured to be positioned at a first obtuse angle with respect to the base longitudinal axis.

8. The light fixture of claim 7, wherein the first obtuse angle is in the range of from about 130° to 170°.

9. The light fixture of claim 7, wherein at least a portion of the first face has an arcuate shape.

10. The light fixture of claim 9, wherein the portion of the first face forms a substantially concave surface.

11. The light fixture of claim 4, wherein the second face is configured to be positioned at a second obtuse angle with respect to the base longitudinal axis.

12. The light fixture of claim 11, wherein the second obtuse angle is in the range of from about 90° to 150°.

13. The light fixture of claim 11, wherein the second obtuse angle is less than the first obtuse angle.

14. The light fixture of claim 11, wherein at least a portion of the second face has an arcuate shape.

15. The light fixture of claim 14, wherein the portion of the second face forms a substantially concave surface.

16. The light fixture of claim 1, wherein the linear light source has at least one end, and wherein each end cap defines an opening constructed and arranged for receiving at least a portion of the at least one end of the linear light source.

17. The light fixture of claim 16, wherein each of the plurality of end caps at least partially defines a chamber adjacent the top portion of the end cap that is in operative communication with the opening in the end cap.

18. The light fixture of claim 17, wherein each of the chambers is configured to receive at least a portion of a selected end of the linear light source therein.

19. The light fixture of claim 18, wherein each chamber is configured to mount an electrical contact for detachably securing the selected end of the linear light source thereto.

20. The light fixture of claim 1, further comprising means for mounting each end cap to the light fixture.

21. The light fixture of claim 20, wherein the means for mounting comprises a plurality of tabs that are configured to selectively connect with complementary slots defined therein the light fixture.

22. The light fixture of claim 21, wherein each tab extends outwardly from a top portion of the end cap.

23. A light fixture for mounting in a ceiling, comprising:

a reflector assembly comprising a longitudinally extending hollow extending inwardly to a central portion between the respective first and second hollow edges, a linear light source configured for mounting therein a portion of the central portion of the reflector assembly; and a plurality of end caps configured for overlying a portion of the linear light source, wherein the plurality of end caps are configured such that at least a portion of the light emitted by the light source passes through the plurality of end caps.

24. The light fixture of claim 23, further comprising a lens assembly configured for mounting to a portion of the central portion of the reflector assembly, wherein the lens assembly overlies at least a portion of the linear light source.

25. The light fixture of claim 24, wherein the lens assembly and the plurality of end caps are configured such that substantially all of the light emitted by the light source passes through the lens assembly and the plurality of end caps.

26. The light fixture of claim 24, wherein the lens assembly controls high angle glare in the longitudinal direction optically.

27. The light fixture of claim 24, further comprising means for detachably connecting the lens assembly to the reflector assembly.

28. The light fixture of claim 24, wherein at least a portion of the lens assembly is positioned below a plane of the ceiling.

29. The light fixture of claim 28, wherein at least a portion of a central lens portion of the lens assembly is positioned below the plane of the ceiling.

30. The light fixture of claim 23, wherein the reflector assembly further comprises an elongated base member having a first end edge and a spaced second end edge, and wherein the light source is positioned below a plane bisecting the respective first or second longitudinally extending side edges of the base member.

31. The light fixture of claim 23, wherein the linear light source comprises a T5 lamp.

32. A light fixture for mounting in a ceiling, comprising:

a reflector assembly extending along a longitudinal axis, a linear light source having at least one end and being configured for mounting within a portion of the reflector assembly; and a plurality of end caps configured for overlying a portion of the linear light source, each end cap defining an opening configured to receive at least a portion of the at least one end of the linear light source therein, each end cap further comprising a first face that is positioned at a first obtuse angle with respect to the longitudinal axis.

33. The light fixture of claim 32, wherein the each end cap further comprises a second face that is positioned at a second obtuse angle with respect to the longitudinal axis.

34. The light fixture of claim 33, wherein the second obtuse angle is less than the first obtuse angle.

35. The light fixture of claim 32, wherein the first obtuse angle is in the range of from about 130° to 170°.

36. The light fixture of claim 33, wherein the second obtuse angle is in the range of from about 90° to 150°.

37. The light fixture of claim 32, wherein the plurality of end caps are configured such that at least a portion of the light emitted by the light source passes through the plurality of end caps.

38. The light fixture of claim 37, further comprising a lens assembly configured for mounting to a portion of the central portion of the reflector assembly, wherein the lens assembly overlies at least a portion of the linear light source.

39. The light fixture of claim 38, wherein the lens assembly and the plurality of end caps are configured such that substantially all of the light emitted by the light source passes through the lens assembly and the plurality of end caps.

40. The light fixture of claim 38, wherein the lens assembly controls high angle glare in the longitudinal direction optically.

* * * * *